US009816704B2

(12) United States Patent
Noman et al.

(10) Patent No.: US 9,816,704 B2
(45) Date of Patent: Nov. 14, 2017

(54) BURNER FOR FLARE STACK

(71) Applicant: Honeywell International Inc., Morristown, NJ (US)

(72) Inventors: Shiblee Noman, Tulsa, OK (US); Kurt Edward Kraus, Tulsa, OK (US); Matthew L. Shannon, Beggs, OK (US)

(73) Assignee: Honeywell International Inc., Morris Plains, NJ (US)

( * ) Notice: Subject to any disclaimer, the term of this patent is extended or adjusted under 35 U.S.C. 154(b) by 421 days.

(21) Appl. No.: 14/674,534

(22) Filed: Mar. 31, 2015

(65) Prior Publication Data

US 2016/0290637 A1 Oct. 6, 2016

(51) Int. Cl.
*F23G 7/08* (2006.01)

(52) U.S. Cl.
CPC ..... *F23G 7/08* (2013.01); *F23D 2900/14021* (2013.01); *F23N 2041/12* (2013.01)

(58) Field of Classification Search
CPC ..... Y10S 239/07; F23D 14/62; F23D 14/08; F23D 14/84; F23D 14/125; F23D 14/38; F23D 14/64; F23D 2900/14482; F23D 11/36; F23D 11/40; F23D 11/402; F23D 11/408; F23D 14/04; F23D 14/045; F23D 14/12; F23D 14/14; B01F 5/045
See application file for complete search history.

(56) References Cited

U.S. PATENT DOCUMENTS

| | | | | |
|---|---|---|---|---|
| 3,833,337 | A * | 9/1974 | Desty | F23G 7/08 239/424 |
| 4,634,370 | A * | 1/1987 | Chesters | F23G 7/08 431/202 |
| 8,337,197 | B2 | 12/2012 | Poe et al. | |
| 2008/0104961 | A1 * | 5/2008 | Bunker | F23R 3/286 60/737 |
| 2014/0329189 | A1 | 11/2014 | McClain et al. | |

FOREIGN PATENT DOCUMENTS

| | | |
|---|---|---|
| EP | 1 825 195 B1 | 2/2013 |
| WO | WO 2014/027914 A1 | 2/2014 |
| WO | WO 2014/088450 A1 | 6/2014 |

* cited by examiner

*Primary Examiner* — Jason Lau

(57) ABSTRACT

A flare gas burner and a process for disposing of a waste gas using such a burner. The burner has a rounded outer surface that includes a plurality of dimples. The dimples increase the mixing of the waste gas and ambient air prior to combustion. The flare gas burner may have a diameter of 0.61 m and between 300 and 400 dimples. The flare gas burner may comprise a cast material.

2 Claims, 3 Drawing Sheets

BURNER FOR FLARE STACK

FIELD OF THE INVENTION

This invention relates generally to a flare burner for a flare stack, and more particularly to a flare burner that produces less noise and a shorter flame than conventional flare burners.

BACKGROUND OF THE INVENTION

Flares have traditionally been utilized for burning and exhausting combustible gases. Commonly, flares are mounted on flare stacks and located at production, refining, and processing plants for disposing of flammable waste gases or other flammable gas streams, which are diverted for any reason, including but not limited to venting, shut-downs, upsets, and/or emergencies. Primarily, flare stacks are used for venting unwanted waste gas streams from a facility.

In order to produce a flame without producing smoke, many flare burners include a tulip shaped Coanda tip. Coanda tips have been used in flares with high flow rates and pressures to cause the adherence of the waste gas to the surface. The negative pressure and viscous forces caused by the Coanda effect cause the fluid to be drawn against the surface in a relatively thin film, which allows proximate fluid (e.g. ambient air) to be mixed efficiently with the fluid stream. For example, U.S. Pat. No. 8,337,197 describes that to achieve a Coanda effect, the surface of the Coanda surface should be substantially smooth.

While the Coanda tipped flare burners are effective at minimizing the production of smoke while combusting gas, some Coanda tipped flare burners produce a long flame. The long flames can be problematic as they require more space to separate from other equipment to avoid damaging same. Additionally, some Coanda tipped flare burners produce a high amount of noise from the exiting gases and combustion of same. The high amount of noise is oftentimes undesirable.

Therefore, it would be desirable to provide a burner that can combust the gases in a smokeless manner without excess noise levels and with shorter flame lengths.

SUMMARY OF THE INVENTION

A flare gas burner and a process for disposing of a waste gas using same have been invented. The flare gas burner comprises a gas deflector with a rounded outer surface that includes a plurality of dimples for increasing the mixing between the waste gas and oxygen in the ambient air.

Accordingly, in a first aspect of the present invention, the present invention may be broadly characterized as providing a gas flare burner including a gas deflector having an outer surface for deflecting gas along the outer surface, the outer surface comprising a plurality of dimples, a waste gas supply tube having an outlet disposed proximate the gas deflector and configured to receive waste gas from a waste gas source, and, an arm for supporting the gas deflector.

In one or more embodiments of the present invention, the gas deflector comprises a bowl shape with a bottom portion, a curved portion and an outer wall portion. It is contemplated that an outer surface of the bottom portion is smooth. It is also contemplated that the outer wall portion terminates in a beveled edge with an outer surface being angled towards a center of the gas deflector. It is further contemplated that an angle of the outer surface of the beveled edge is approximately 10 degrees from an outer surface of the outer wall portion.

In various embodiments of the present invention, the outlet comprises a gap between the outer surface of the gas deflector and the waste gas supply tube. It is contemplated that the gap is adjustable.

In at least one embodiment of the present invention, the arm is biased by a biasing element.

In some embodiments of the present invention, a diameter of the outer surface of the gas deflector comprises approximately 0.61 m (2 ft). It is contemplated that the outer surface includes between 330 and 340 dimples.

In various embodiments of the present invention, the outer surface includes between 300 and 400 dimples.

In one or more embodiments of the present invention, the dimples include a diameter between 3.1 to 4.5 cm (1.25 to 1.75 inches).

In some embodiments of the present invention, the dimples have a depth of between 2.4 to 5.1 mm (0.1 to 0.2 inches).

In at least one embodiment of the present invention, the gas deflecting surface comprises a cast material and the dimples are formed in the cast.

In many embodiments of the present invention, the dimples are arranged such that centers of a first plurality of dimples are spaced apart equidistant along a first circle, and centers of a second plurality of dimples are spaced apart equidistant along a second circle. The first circle and the second circle are concentric. It is contemplated that the first plurality of dimples are offset from the second plurality of dimples. It is further contemplated that centers of a third plurality of dimples are spaced apart equidistant along a third circle, and the third circle is concentric with the first circle and the second circle. It is further contemplated that the third plurality of dimples are offset from the second plurality of dimples.

In a second aspect of the present invention, the present invention may be broadly characterized as providing a process for disposing of a waste gas by: passing a waste gas to a gas flare burner comprising a gas deflector having an outer surface for deflecting gas along the outer surface, wherein the outer surface of the gas deflector comprises a plurality of dimples; flowing the waste gas over the outer surface so as to mix oxygen with the waste gas to provide a mixed waste gas; and, igniting the mixed waste gas above the gas flare burner to produce a flame.

In some embodiments of the present invention, a diameter of the outer surface of the gas deflector comprises approximately 0.61 m (2 ft) and the outer surface includes between 300 and 400 dimples.

Additional aspects, embodiments, and details of the invention, which may be combined in any manner, are set forth in the following detailed description of the invention.

DETAILED DESCRIPTION OF THE DRAWINGS

One or more exemplary embodiments of the present invention will be described below in conjunction with the following drawing figures, in which.

DETAILED DESCRIPTION OF THE INVENTION

As mentioned above, a flare burner has been invented in which the burner provides the benefits of a Coanda tipped flare burner but with a shorter flame length and without producing as much noise. The outer surface of the Coanda surface includes a plurality of dimples. With this design, the drag force on the outer surface will be reduced by the Magnus effect, so the waste gas passing over the outer surface will obtain a higher velocity. This higher velocity of gas will inspire more air with it, which will increase the mixing of waste gas and air before combustion and will reduce the flame length produced by combustion. The dimple pattern is also believed to impact on the natural frequency of the semi-sphere, and thus is further believed that in some instances the noise can be reduced by 22% (from 75.3 dB to 58.5 dB).

With these general principles in mind, one or more embodiments of the present invention will be described with the understanding that the following description is not intended to be limiting.

The apparatus and method presented herein, in accordance with various aspects, relates to reducing smoke formation during combustion of a waste gas in a flare stack. The apparatus may be used with a flare stack, for example, at a refinery or production facility for flaring waste gas or other gas streams to the atmosphere. As used herein, the term "waste gas" refers to any combustible gas stream that is combusted by the flare stack, including, but not limited to undesired gas streams, product streams combusted during shutdown or emergency situations, and other streams.

Figure 1:
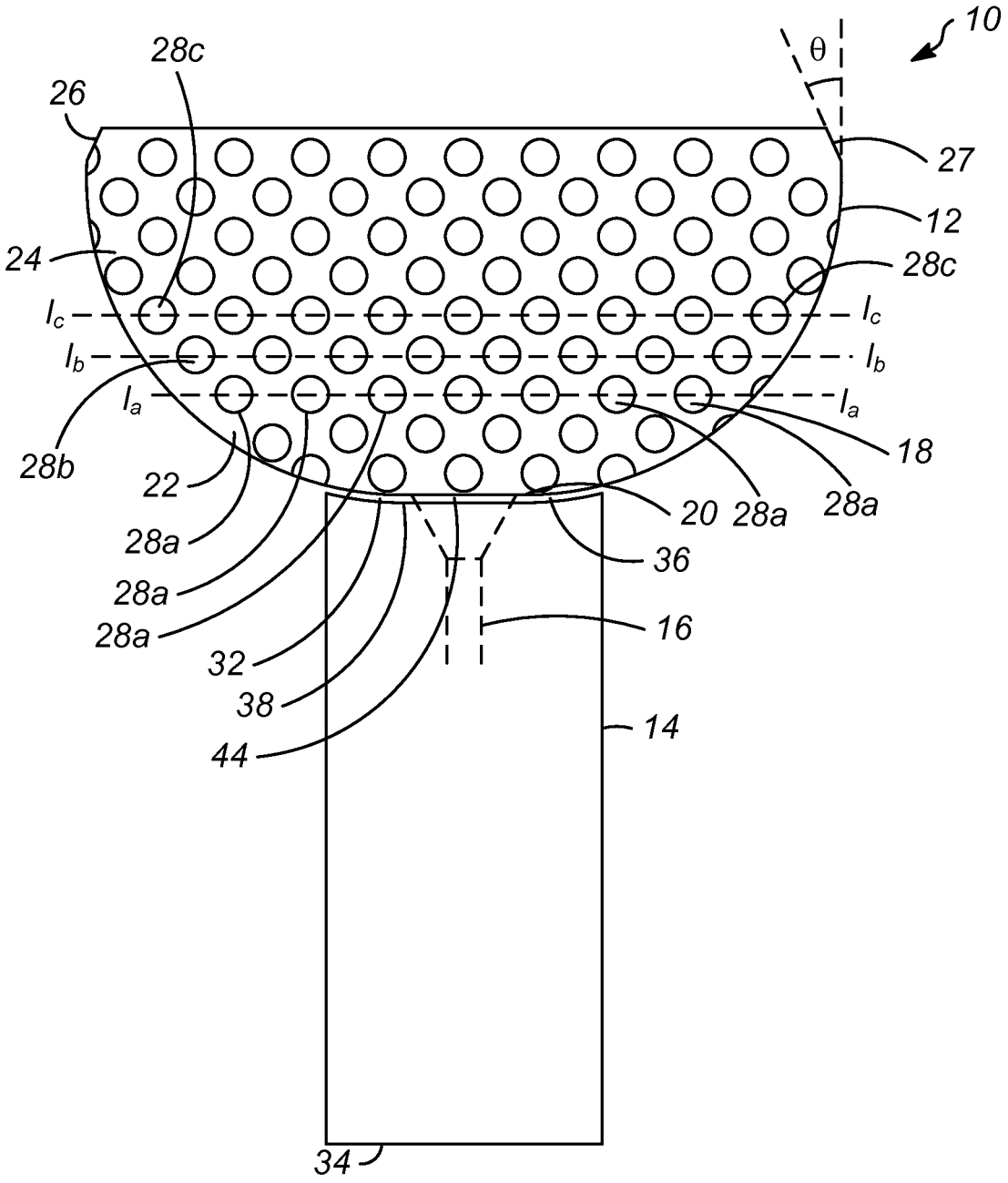
FIG. 1 shows a side view of a burner according to one or more embodiments of the present invention.
Figure 2:
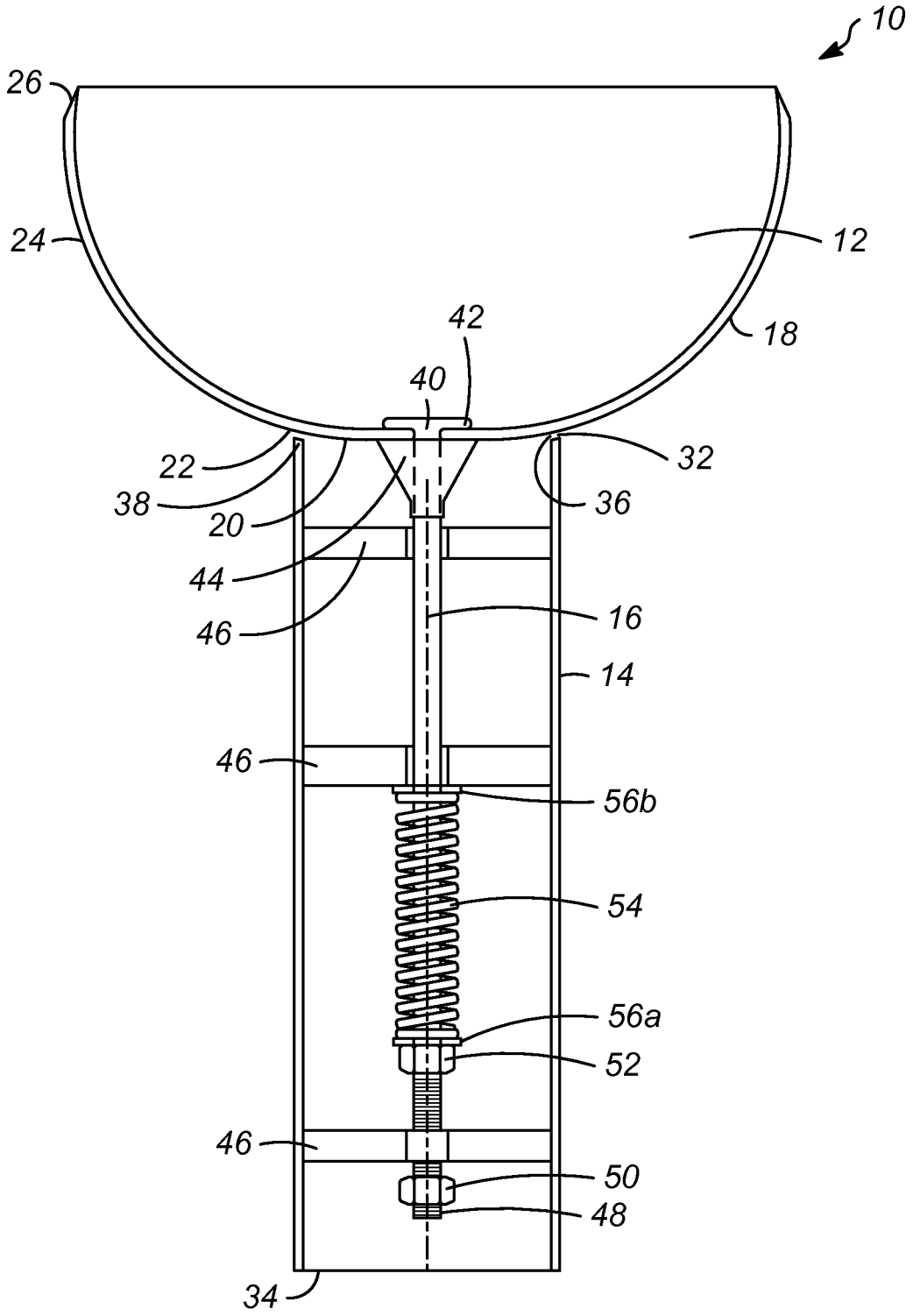
FIG. 2 shows a side cutaway view of the burner shown in FIG. 1.

Referring now to FIGS. 1 and 2, a flare burner 10 for the combustion of a waste gas stream in accordance with various aspects is provided. The apparatus 10 includes a gas deflector 12, a waste gas supply tube 14, and an arm 16 for supporting the gas deflector 12. Although not depicted as such, it is contemplated that the arm 16 and waste gas supply tube 14 are combined into a single element such that the waste gas supply tube 14 supports the gas deflector 12.

The gas deflector 12 is for deflecting fluid, preferably waste gas, along an outer surface 18 thereof Preferably, the gas deflector 12 comprises a bowl or tulip shape, having a bottom portion 20, a curved portion 22, and an outer wall portion 24. The outer wall portion 24 of the gas deflector 12 is generally vertical and may terminate in at a tip 26. Preferably, the tip 26 includes a beveled edge 27 angled towards a center 30 of the gas deflector 12 (see FIG. 3). The beveled edge 27 may comprises an angle $\Theta_1$ that is approximately 10 degrees (+/−2 degrees). The bottom portion 20 of the gas deflector 12 is generally horizontal. Finally, the curved portion 24 of the gas deflector 12 comprises the portion of the outer surface 18 between the outer wall portion 24 and the bottom portion 20.

In the various embodiments of the present invention, the outer surface 18 of the gas deflector 12 comprises a plurality of dimples 28. In a preferred embodiment, a largest outer diameter of the gas deflector 12 is approximately 0.61 m (2 ft), and the outer surface 18 comprises between 300 and 400 dimples, most preferably between 330 and 340 dimples.

The dimples 28 may comprise any shape or design, however it is believed that rounded dimples 28 (such as those dimples on a golf ball, see, U.S. Pat. No. 5,957,786) provide the best utility as other shapes may increase drag and lower the velocity of the fluid flowing past. In a preferred embodiment, the dimples 28 comprise a concave indentation with a depth of between 2.4 to 5.1 mm (0.1 and 0.2 inches) and an outer diameter between 3.1 to 4.5 cm (1.25 to 1.75 inches).

In a most preferred embodiment, the gas deflector 12 is made from a cast material, such as a ceramic, in which the dimples 28 may be formed during the fabrication of the gas deflector 12. It is believed that such a construction will provide for a gas deflector that weighs less compared to, for example, a gas deflector made from metal in which the dimples 28 would be formed therein by compressing or otherwise deforming the metal.

As mentioned above, the dimples 28 increase the velocity of the gas passing over the outer surface 18, thus entraining more of the surrounding air. This will produce a shorter, and more stable flame when the waste gas is combusted. It is also believed that the layout of the dimples 28 may impact the noise produced by the flare burner 10.

A preferred layout for the dimples 28 is shown in FIG. 1 in which centers of a first plurality of dimples 28*a* are spaced apart equidistant along a first circle (shown as line $\mathbf{1}_a$-$\mathbf{1}_a$). Centers of a second plurality of dimples 28*b* are spaced apart equidistant along a second circle (shown as line $\mathbf{1}_b$-$\mathbf{1}_b$). The first circle $\mathbf{1}_a$-$\mathbf{1}_a$ and the second circle $\mathbf{1}_b$-$\mathbf{1}_b$ may be concentric. In a preferred embodiment, the first plurality of dimples 28*a* and the second plurality of dimples 28*a* are preferably offset.

As shown in FIG. 1, centers of a third plurality of dimples 28*c* are spaced apart equidistant along a third circle (shown as line $\mathbf{1}_c$-$\mathbf{1}_c$). The third circle $\mathbf{1}_c$-$\mathbf{1}_c$ may be concentric with the first circle $\mathbf{1}_a$-$\mathbf{1}_a$ and the second circle $\mathbf{1}_b$-$\mathbf{1}_b$. Preferably, the dimples 28*c* on the third circle $\mathbf{1}_c$-$\mathbf{1}_c$ are offset from the dimples 28*b* on the second circle $\mathbf{1}_b$-$\mathbf{1}_b$, and most preferably, the dimples 28*c* on the third circle $\mathbf{1}_c$-$\mathbf{1}_c$ are also aligned with the dimples 28*a* on the first circle $\mathbf{1}_a$-$\mathbf{1}_a$.

Generally, the dimples 28 may be arranged in alternating rows (or circles) as shown in FIG. 1 with each row being offset from the immediately adjacent row. Again, the foregoing layout of dimples 28 is merely preferred and is not intended to be limiting. Preferably, the bottom portion 20 of the gas deflector 12 is smooth. By "smooth" is it meant that the bottom portion 20 of the gas deflector 12 does not include any dimples 28.

In order to provide waste gas to the flare burner 10, the waste gas supply tube 14 includes an outlet 32 proximate the gas deflector 12 and an inlet 34 configured to receive waste gas from a waste gas source (not shown). Preferably, the outlet 32 comprises a gap 36 between the outer surface 18 of the gas deflector 12 and an end 38 of the waste gas supply tube 14. A preferred gap 36 is between 6.3 to 25.4 mm (¼ and 1 inch). In some embodiments the gap 36 may be adjustable (discussed below).

Figure 3:
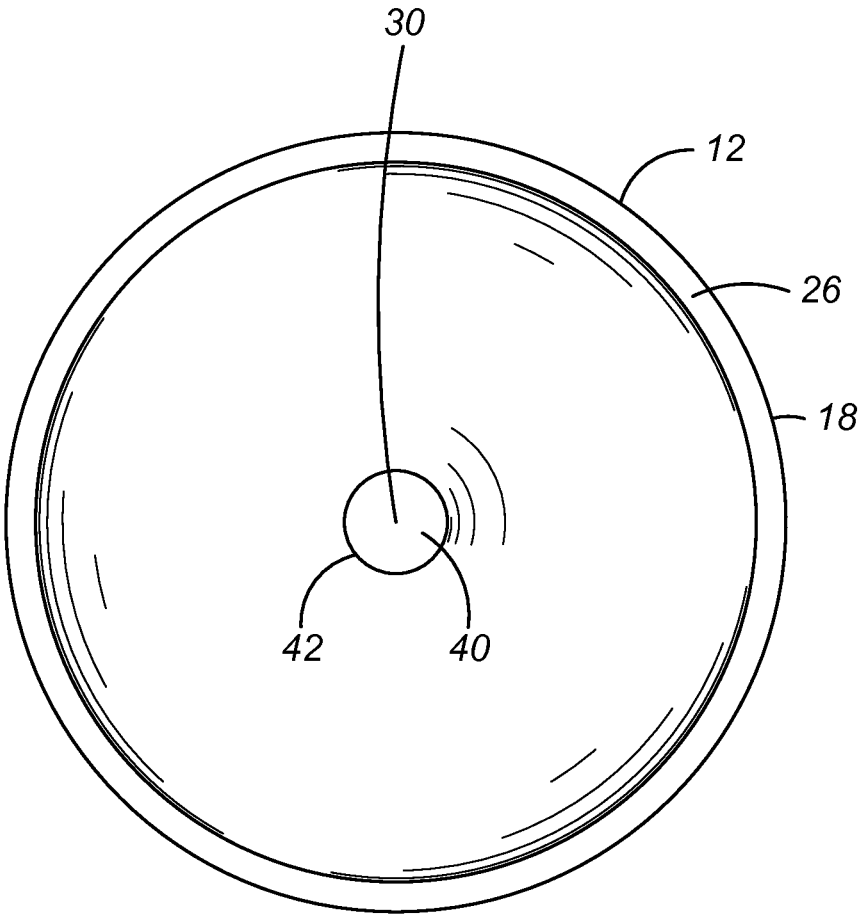
FIG. 3 shows a top view of the burner shown in FIG. 1.

As shown best in FIG. 2, the arm 16 supports the gas deflector 12 and preferably is disposed inside of the waste gas supply tube 14. As shown in FIGS. 2 and 3, a first end 40 of the arm 16 may extend through the bottom portion 20 of the gas deflector 12 through an orifice (not shown). The first end 40 of the arm 16 may comprise a head 42 which may cooperate with a stopper 44 disposed about the arm 16 abutting the outer surface 18 of the gas deflector 12. One or more support brackets 47 may be disposed in the waste gas supply tube 14 for maintaining the arm 16, and the gas deflector 12, in a relatively upright, or vertical, orientation.

A second end 46 of the arm 16 is preferably threaded and may pass through an orifice (not shown) in a support bracket 47. A first fastening element 50, such as a nut or the like, may be secured to the second end 46 via an orifice (not shown) configured complementary to the second end 46 of the arm 16. Additionally, a second fastening element 52, such as a nut or the like, may be disposed on the arm 16 between the first end 40 of the arm 16 and the first fastening element 50. Proximate the second fastening element 52 is a biasing element 54 that may be disposed between two washers 56*a*, 56*b*. A preferred biasing element 54 comprises a spring biased to expand outwardly. One washer 56*a* may be disposed between the biasing element 54 and the second fastening element 52. A second washer 56*b* may be disposed between the biasing element 54 and a support bracket 47. The force exerted by the biasing element 54 will support the arm 16 and gas deflector 12 and further may provide the gap 36. Adjusting the second fastening element 52 will increase or decrease the compression on the biasing element 54 (depending on the direction of rotation), allowing the gap 36 to be adjustable.

In use, waste gas, from a waste gas source will travel in though the inlet 34 of the waste gas supply tube 14. In the waste gas supply tube 14, the waste gas will travel upwards, and exit the waste gas supply tube 14 through the outlet 32 (some waste gas may flow along the bottom portion 20 of the gas deflector 12 before passing through the outlet 32). The waste gas will flow along the outer surface 18 of the gas deflector 12 due to the "Coanda effect," wherein gases flowing along a surface thereof tend to follow the surface forming a thin film and drawing in surrounding gas or air. Thus, as the waste gas travels upward along the outer surface 18 of the gas deflector 12, the waste gas will mix with oxygen in the atmosphere. As a result of the dimples 28, the velocity of the waste gas will be increased as it flows along the outer surface 18 of the gas deflector 12. The increase in velocity will increase the mixing of the waste gas and the surrounding air.

The mixture of waste gas and air will continue to flow upwards along the outer surface 18 of the gas deflector 12 and finally, pass from the gas deflector 12 to a combustion zone, disposed above the gas deflector 12. In the combustion zone, the combustible compounds in the waste gas and oxygen will react to produce a flame. A flame source (not shown) may provide an ignition, or the mixture of waste gas and oxygen may fuel an existing flame.

By incorporating the dimples into the outer surface of the gas deflector the velocity of the gas may be increased. This will result in waste gas having a higher velocity, which will in turn provides improved mixing of the waste gas and surrounding air before the waste gas reaches the combustion zone. Having an improved mixture of waste gas and air will result in a flame that is shorter and stronger when the mixture is combusted. Additionally, the layout of the dimples may be utilized to provide a burner that produces a lower level of noise.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A gas flare burner comprising:

a gas deflector comprising a bowl shape with a bottom portion, a curved portion and an outer wall portion wherein the gas deflector has an outer surface for deflecting gas along the outer surface, the outer surface comprising a plurality of dimples and wherein the outer wall portion terminates in a beveled edge with an outer surface being angled towards a center of the gas deflector;

a waste gas supply tube having an outlet disposed proximate the gas deflector and configured to receive waste gas from a waste gas source; and, an arm for supporting the gas deflector.

2. The gas flare burner of claim 1 wherein an angle of the outer surface of the beveled edge is approximately 10 degrees from an outer surface of the outer wall portion.

* * * * *